United States Patent [19]

Zaugg et al.

[11] 4,074,792

[45] Feb. 21, 1978

[54] PORTABLE HANGING SCAFFOLD

[76] Inventors: Alonzo N. Zaugg, Rte. 2, Box 226, Rigby, Idaho 83442; Richard W. Ellis, Box 13, Ririe, Idaho 83443

[21] Appl. No.: 795,938

[22] Filed: May 11, 1977

[51] Int. Cl.[2] ..... E04G 3/10

[52] U.S. Cl. ..... 182/150; 182/117

[58] Field of Search ..... 182/150, 117, 82, 222, 182/223, 45

[56] References Cited

U.S. PATENT DOCUMENTS

| | | | |
|---|---|---|---|
| 2,308,142 | 1/1943 | Alloway | 182/150 |
| 2,957,670 | 10/1960 | Wendl | 182/150 |
| 2,966,228 | 12/1960 | Kowalski | 182/150 |
| 3,135,351 | 6/1964 | Economos | 182/150 |
| 3,391,757 | 7/1968 | Duke | 182/150 |
| 3,767,010 | 10/1973 | Newlan | 182/150 |
| 3,900,082 | 8/1975 | Rea | 182/150 |

*Primary Examiner*—Reinaldo P. Machado
*Attorney, Agent, or Firm*—D. Paul Weaver

[57] ABSTRACT

A strong lightweight hanging scaffold for four or more workmen with heavy materials has a wide range of adjustability adapting it for a variety of uses on many types of one and two story buildings including buildings with gable ends. The scaffold features strong top and bottom truss arms or beams which are vertically adjustable on end vertical ladder-type frames. A sturdy walkway of box form has a non-slip metal walking surface and may be employed in both level and inclined positions while resting on the bottom truss arms. Top spiked engaging bars of the upper truss arms have swiveled connections therewith so as to be compatible with various roof contours. The lower truss arms have extension bars with feet adapted for stable engagement with building walls.

12 Claims, 10 Drawing Figures

28
21
23
19
27
22
20
24
17
18
16
30
26
15
50
53'
42
40
53
37
56
33
32
34
36
35
51
52
44
43
42'

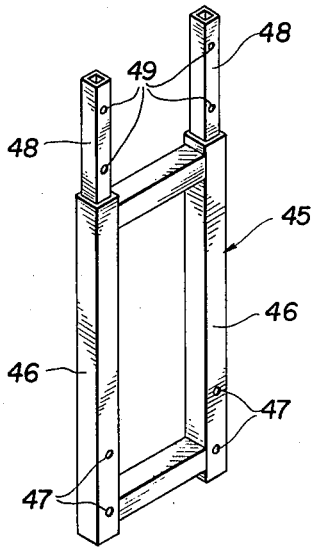
FIG.8
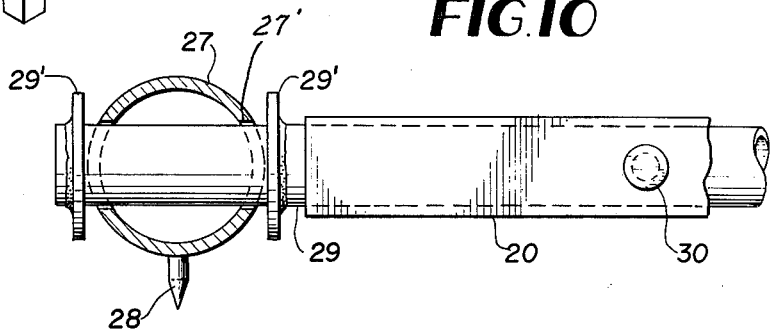
FIG.10
FIG.9
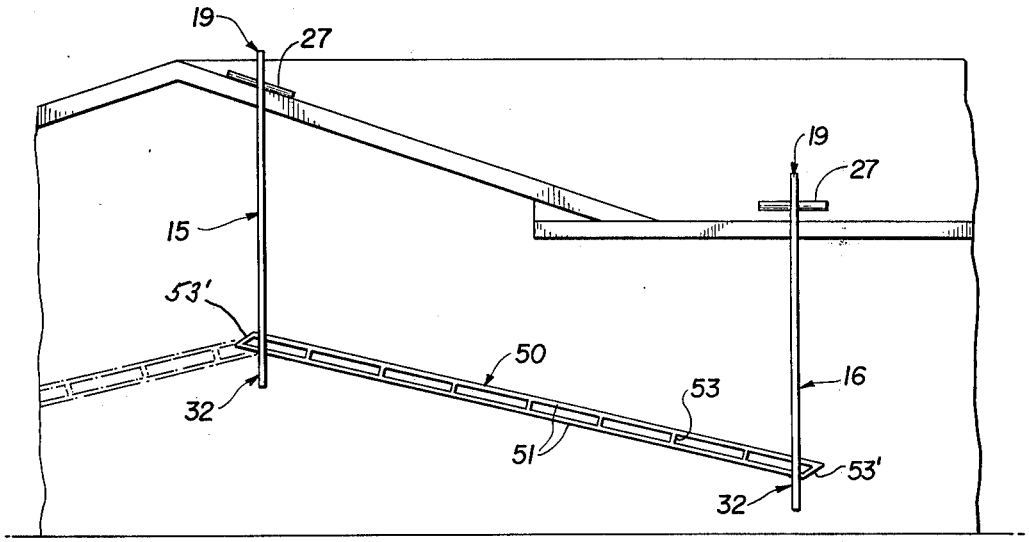

PORTABLE HANGING SCAFFOLD

BACKGROUND OF THE INVENTION

Portable knock-down scaffolds including hanging scaffolds are known in the prior art and some examples of the patented prior art are contained in U.S. Pat. Nos. 313,465; 3,158,223; 3,552,522; 3,601,222 and 3,767,010. While the prior art is quite highly developed, nevertheless there is a need for a more efficient, comparatively stronger and lighter weight hanging scaffold which is more readily adaptable to a wider variety of building structures, safer and more convenient to set up and adjust. It is the objective of the present invention to satisfy these and other needs and deficiencies in the prior art by providing a better all-purpose hanging scaffold which is particularly adapted for use on one or two story structures including frame structures. Another specific object of the invention is to provide a portable knock-down scaffold which will safely support four or more workmen with supplies.

A further object is to provide a hanging scaffold having overhead rigid truss suspension arms including swiveled spiked engaging bars which adapt the scaffold to gable end houses and various roof slopes. The scaffold can accommodate practically any width of eave overhang and is particularly useful in connection with siding and soffet work because the interior side of the scaffold facing the siding is completely open and unobstructed.

Other features and advantages of the invention will become apparent during the course of the following description.

BRIEF DESCRIPTION OF THE DRAWINGS

FIG. 8 is a perspective view of an extension frame section for use with the vertical ladder frames of the truss.

FIG. 9 is a partly schematic front elevation of the truss showing its adaptability to gable end homes.

FIG. 10 is a fragmentary elevational view showing a swivel connection between a spiked roof engaging bar and each upper truss arm of the scaffold.

DETAILED DESCRIPTION

Figure 2:
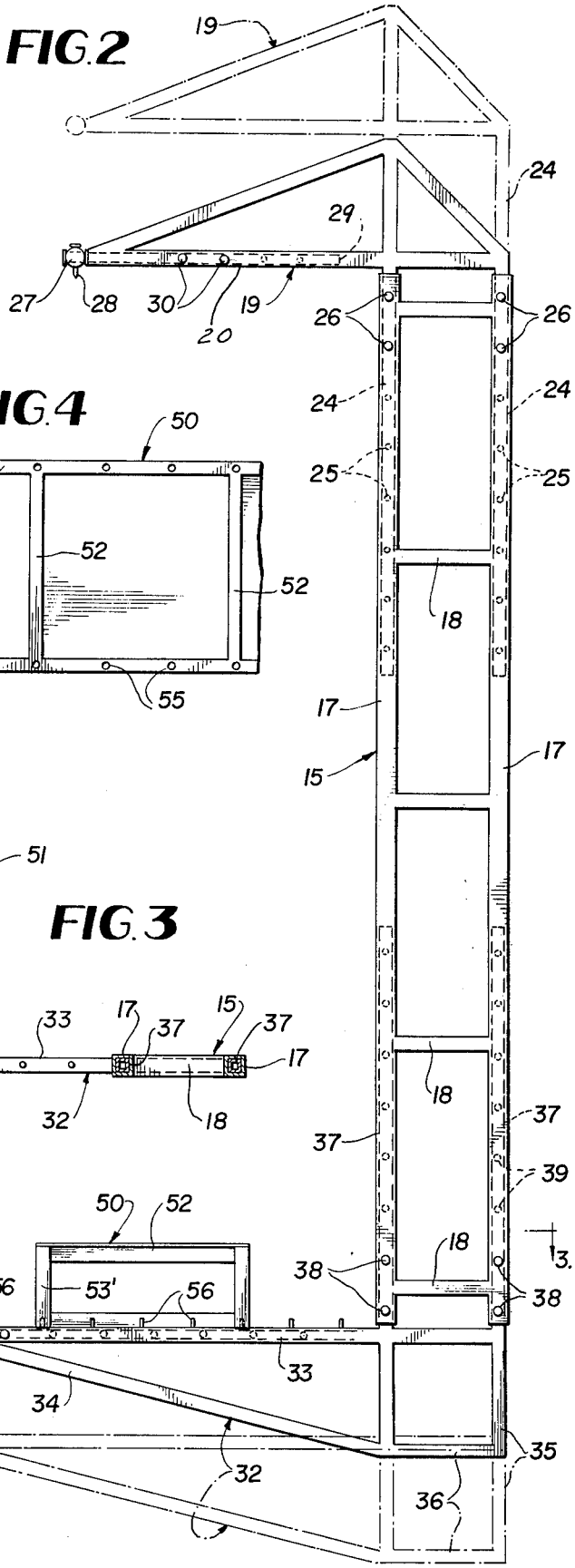
FIG. 2 is a side elevation thereof with adjustable components shown in extended positions in broken lines.

Referring to the drawings in detail wherein like numerals designate like parts, a portable knock-down scaffold of wide utility comprises end vertical ladder frames 15 and 16 each having a pair of spaced parallel vertical rectangular cross section tubular frame members 17 and connecting braces 18, as illustrated. Associated with each ladder frame of the scaffold is a top suspension arm or truss 19 of very rigid construction in a vertical plane and including a horizontal bar 20 and overhead converging inclined truss bars 21 and 22 connected with the bar 20 by a vertical brace 23 at the apex of the truss. Each upper arm or truss 19 forms the suspension member for the adjacent vertical ladder frame 15 or 16 and further includes spaced vertical depending extension bars 24 which are received telescopically and adjustably within the tops of the tubular frame members 17. The extension bars 24 and the other components of the trusses 19 are of rectangular cross section, as illustrated. The extension bars 24 are apertured at plural points 25 along their lengths to receive locking pins 26 removably contained within pairs of apertures in the members 17, which apertures may register with selected pairs of the apertures 25. In this manner, the upper horizontal trusses 19 may be vertically adjusted relative to the ladder frames 15 to increase or decrease the vertical dimension of the scaffold as depicted in broken lines in FIG. 2, the pins 26 locking the upper trusses 19 in selected adjusted positions.

Each upper arm or truss 19 is equipped at its forward end with a transverse preferably cylindrical roof engaging bar 27 of sufficient length to provide a stable and secure mounting of the hanging scaffold. Each engaging bar 27 has a plurality of depending spikes 28 fixedly secured thereto to penetrate and grip the roof surface during use of the scaffold. Each engaging bar 27 is provided at its longitudinal center with a transverse through opening 27' to receive an adjustable support bar 29 which is telescopically engaged in the horizontal bar 20 of the top suspension arm or truss 19. A pair of washers 29' is welded to the bar 29 on opposite sides of the engaging bar 27, whereby the latter is held captive on the bar 29 but is freely swiveled for turning circumferentially of the bar 29. With this arrangement, the engaging bars 27 can adjust themselves automatically to the slope of any roof, such as the roof of the gable end structure shown in FIG. 9. The bar or arm 29 is extensible and retractable in the horizontal truss bar 20 to accommodate variations in eave overhang which may be encountered with the scaffold. Locking pins 30 are provided to engage adjusting apertures in the bars 29 and 20 so that each bar 29 can be longitudinally adjusted and locked relative to the upper truss 19 in various selected adjusted positions.

The hanging scaffold further comprises lower horizontal truss arms 32 similar to the upper trusses 19 and extending at right angles to the ladder frames 15 and 16 and forwardly thereof toward the side wall of the structure on which the truss is mounted. The lower truss arms 32 are somewhat longer than the upper trusses 19 and they include horizontal bars 33 and underslung braces 34, as well as vertical elements 35. The lower truss arms also carry dependent step bars 36 by means of which workmen can step up onto the scaffold walkway. All of these bar elements making up lower truss arms 32 lie in a common vertical plane on each truss arm.

To facilitate vertical adjustment, each lower truss arm 32 carries at its rear end upstanding vertical parallel spaced extension bars 37 which are received telescopically within the bottoms of the vertical members 17. Locking pins 38, identical to the pins 26, engage spaced apertures 39 in the bars 37 to secure the truss arms 32 in a variety of selected adjusted positions. Thus, it may be seen that the overall vertical dimension of the hanging scaffold can be varied through wide limits to accommodate different building structure needs during usage.

The lower truss arms 32 are adjustable in length so that the scaffold can be used on buildings of almost any eave overhang distance or building wall inset. For this purpose, elongated apertured extension bars 40 are telescopically engaged in the bars 33 adjustably and are locked in selected adjusted positions by side locking pins 41 which may be identical to the pins 38 and 26. At their forward ends, the extension bars 40 have vertical foot plates 42 rigidly mounted thereon for building side wall engagement and these plates are apertured as at 43 to accept nails 44 through which the truss arms 32 are temporarily anchored to the building side wall for safety.

Figures 1, 6, 7:
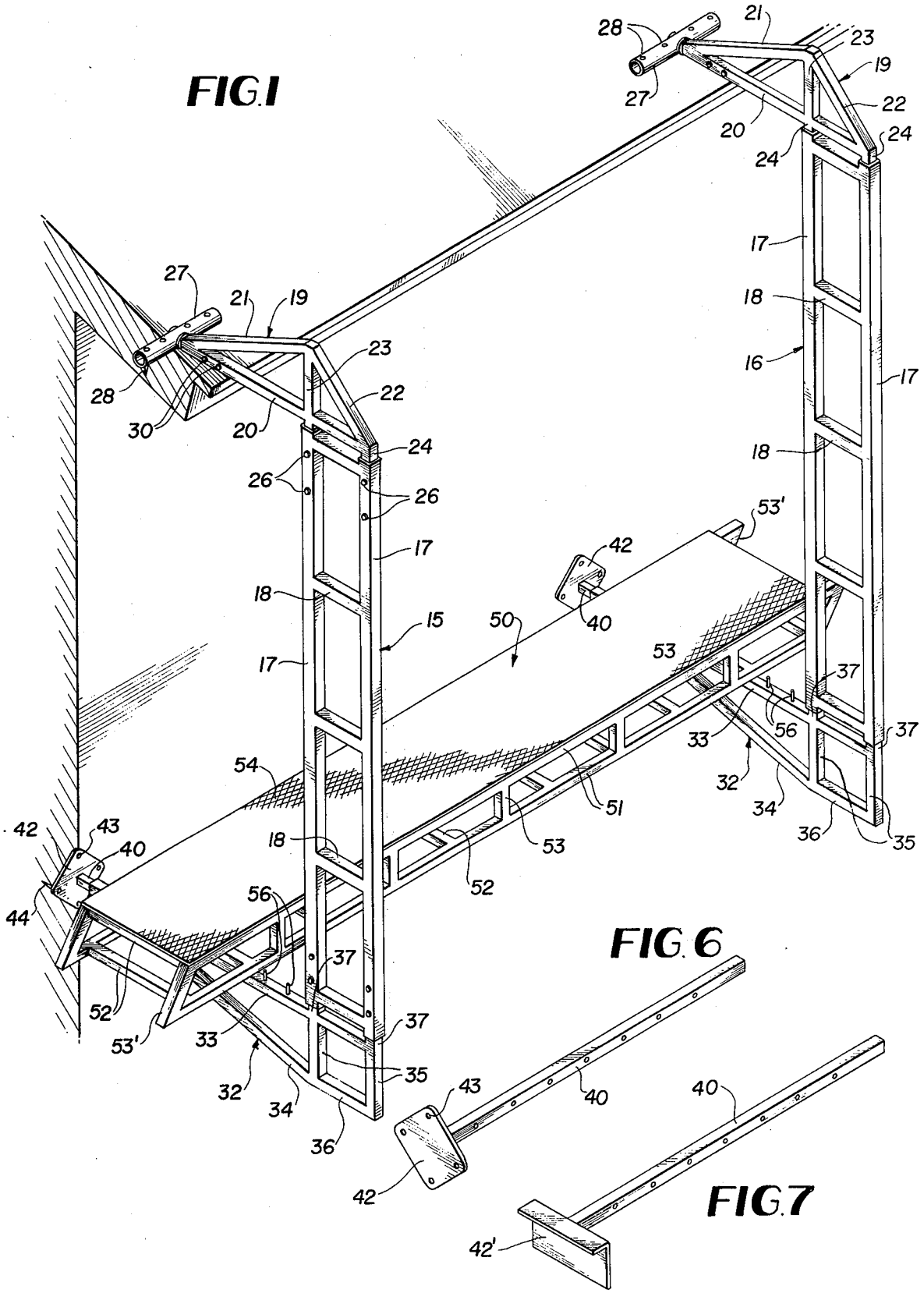
FIG. 1 is a perspective view of a hanging scaffold embodying the invention.
FIG. 6 is a perspective view of an extension bar and foot for each lower truss arm of the scaffold.
FIG. 7 is a similar view of a modified extension arm and foot.
Figure 5:
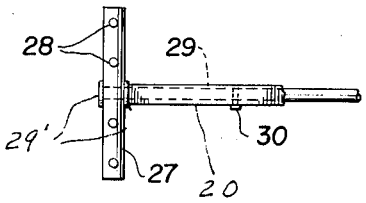
FIG. 5 is a fragmentary plan view of a roof engaging bar carried by each upper truss arm or beam.

As illustrated in FIG. 7, a modified form of foot plate 42' in the nature of an angle may be provided on each extension bar 40 in lieu of the flat foot plate 42. The angle foot plate is more advantageous in certain situations where horizontal window ledges or copings are engaged by the scaffold.

A further feature of the invention increasing its flexibility of usage is the provision of extension sections for the top and bottom ends of the vertical ladder frames 15 and 16. One such extension frame section 45 is shown in FIG. 8. It includes side vertical rectangular tubes 46 which may receive the bars 37 or 24 of trusses 32 or 19 and be locked thereto by the pins 38 or 26. Apertures 47 are provided in the tubes 46 for this purpose. Apertured extension bars 48 on each extension frame section 45 are telescopically engageable within either end of the ladder frames 15 or 16 and can be locked thereto by additional pins 26 and 38, apertures 49 being provided for this purpose, FIG. 8.

The scaffold further comprises a rigid relatively lightweight walkway 50 having a box frame which includes top and bottom spaced parallel longitudinal members 51, transverse cross braces 52 for the top and bottom members 51 and spaced short vertical braces 53, all rigidly interconnected. To facilitate using the hanging scaffold in plural units with the walkways 50 angled relative to each other as shown in FIG. 9, the endmost top-to-bottom braces 53' of the walkway are preferably angled as indicated in the drawings. The top side of the walkway 50 is covered by a panel of non-slip metal 54 of a conventional type secured to the members 51 and 52 in any conventional way.

Figure 4:
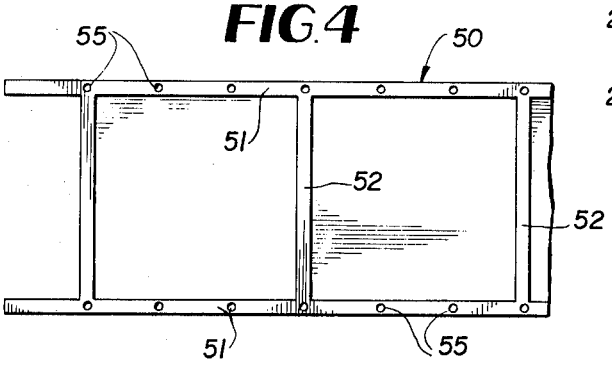
FIG. 4 is a fragmentary bottom plan view of a walkway.
Figure 3:
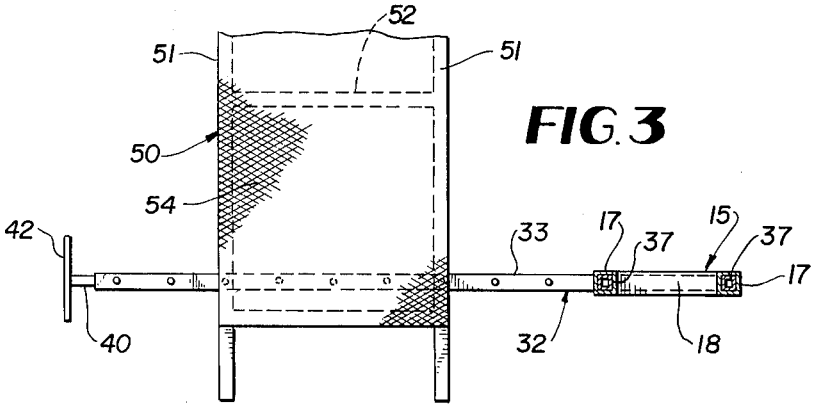
FIG. 3 is a horizontal section taken on line 3—3 of FIG. 2.
Figure 3:
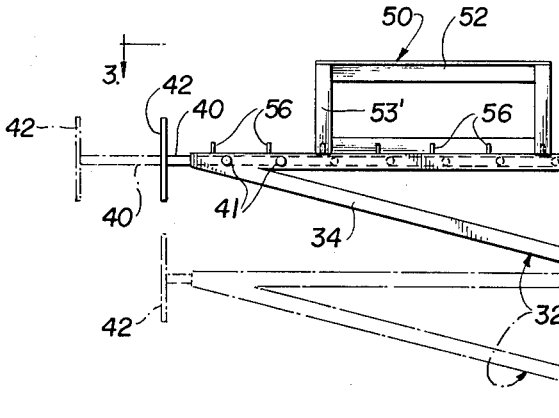

The unitary walkway 50 rests during use on top of the truss arms 32 normally in a level state, FIG. 1, but is capable of assuming an inclined use position as in FIG. 9 when the vertical ladder frames and trusses 19 and 32 are properly adjusted. To prevent slippage of the walkway 50 relative to the bars 33, the lower longitudinal members 51, FIG. 4, of the walkway box frame are provided with a series of equidistantly spaced openings 55 throughout their lengths and these openings receive short upstanding rigid pins 56 carried by the tops of bars 33 in spaced relation on such bars, FIG. 2. Thus, the walkway or platform 50 can be adjusted longitudinally or across the lower truss arms 32 and laterally or toward and away from the wall of the structure on which the scaffold is mounted. The multiple openings 55 along the bottom of the walkway 50 and the multiple pins 56 upstanding from the bars 33 give a wide adjustment range to the walkway 50 and prevent it from slipping even when inclined as in FIG. 9.

The entire scaffold can easily be knocked-down to a compact group of parts for transport or storage. No screw-threaded connections are employed and no tools are required for assembling or dismantling the scaffold.

The advantages of the invention over the prior art should now be apparent to those skilled in the art without the necessity for a further description.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A hanging scaffold comprising a pair of end vertical frames each having a pair of vertical open ended tubular members, upper and lower pairs of horizontal support arms each having pairs of spaced vertical extension bars adapted for adjustable telescopic engagement within said tubular members, means to releasably lock the extension bars in selected adjusted positions within the tubular members to establish the overall vertical height of the scaffold, the upper pair of horizontal support arms being engageable with a building structure to suspend the scaffold thereon and lower pair of support arms adapted to engage a wall of a building structure, a walkway formed as a separate unit and adapted to rest bodily on said lower pair of support arms, and selectively engageable plural interlocking means on the walkway and pair of lower support arms enabling the walkway to be adjusted longitudinally and laterally on the pair of lower support arms.

2. A hanging scaffold as defined in claim 1, and the support arms of said upper and lower pairs comprising trusses whose members are arranged in common vertical planes with said end vertical frames, said end vertical frames comprising ladder frames.

3. A hanging scaffold as defined in claim 1, and said walkway comprising a unitized box frame having upper and lower longitudinal frame members and cross braces interconnecting said frame members horizontally and vertically, a non-slip walking panel affixed to the top of said walkway, and said selectively engageable plural interlocking means comprising multiple spaced openings in the bottom faces of said lower frame members, and multiple spaced upstanding pins on said lower support arms adapted for selective entry into said openings for positioning the walkway in a chosen use position.

4. A hanging scaffold as defined in claim 1, and engaging bars on the forward ends of the upper pair of horizontal support arms and having swiveled connections with said support arms whereby said engaging bars can adjust themselves to varying roof contours.

5. A hanging scaffold as defined in claim 4, and depending spike elements on said engaging bars, said engaging bars extending transversely of the support arms of said upper pair on opposite sides thereof.

6. A hanging scaffold as defined in claim 1, and telescopically adjustable extension bars for said lower pair of horizontal support arms including wall engaging feet, and means to releasably lock said extension bars in selected horizontally adjusted positions.

7. A hanging scaffold as defined in claim 1, and at least one telescoping frame section for each of said vertical frames whereby the lengths of the vertical frames may be increased in the scaffold, each telescoping frame section having telescopic engagement with its associated vertical frame and its associated upper or lower horizontal support arm.

8. A hanging scaffold as defined in claim 2, and the vertical open-ended tubular members of said ladder frames being rectangular in cross section, and said vertical extension bars of the upper and lower pairs of horizontal support arms being of rectangular cross section.

9. A hanging scaffold as defined in claim 8, and said means to releasably lock the extension bars in selected adjusted positions comprising releasable pins engageable through spaced apertures of the extension bars and vertical open-ended tubular members.

10. A hanging scaffold as defined in claim 1, and the truss members of the upper pair of support arms being inclined and projecting above a horizontal member of each upper support arm, and the truss members of the lower pair of support arms being inclined and underslung relative to horizontal members of the lower support arms.

11. A hanging scaffold as defined in claim 4, and said upper pair of horizontal support arms including longitudinally extensible telescoping bars, and said engaging bars being swiveled to said longitudinally extensible telescoping bars.

12. A hanging scaffold as defined in claim 1, and said upper and lower pairs of horizontal support arms including longitudinally extensible telescoping bar members, and means to releasably lock said bar members in selected adjusted positions.

* * * * *